US007645362B2

(12) United States Patent
Kato et al.

(10) Patent No.: US 7,645,362 B2
(45) Date of Patent: Jan. 12, 2010

(54) METHOD FOR PRETREATING AND IMPROVING COKING COAL QUALITY FOR BLAST FURNACE COKE

(75) Inventors: Kenji Kato, Futtsu (JP); Yukihiro Kubota, Futtsu (JP); Takashi Arima, Futtsu (JP); Masaki Sasaki, Tokai (JP); Makoto Matsuura, Tokai (JP); Hiroki Nakai, Tokai (JP)

(73) Assignee: The Japan Iron and Steel Federation, Tokyo (JP)

( * ) Notice: Subject to any disclaimer, the term of this patent is extended or adjusted under 35 U.S.C. 154(b) by 694 days.

(21) Appl. No.: 10/938,266

(22) Filed: Sep. 10, 2004

(65) Prior Publication Data

US 2007/0187222 A1 Aug. 16, 2007

(30) Foreign Application Priority Data

Sep. 11, 2003 (JP) ..... 2003-319772

(51) Int. Cl.

| | |
|---|---|
| ***C10G 1/00*** | (2006.01) |
| *C10L 5/00* | (2006.01) |
| *C10B 49/00* | (2006.01) |
| *C10B 53/00* | (2006.01) |
| *C10B 55/00* | (2006.01) |

(52) U.S. Cl. ..... 201/1; 201/17; 208/404; 208/405; 44/608; 44/621; 44/622; 44/627; 44/629

(58) Field of Classification Search ..... 208/404, 208/405; 44/621, 622, 627, 608, 629; 201/1, 201/17

See application file for complete search history.

(56) References Cited

U.S. PATENT DOCUMENTS

| | | | | |
|---|---|---|---|---|
| 3,619,376 | A * | 11/1971 | Patel et al. | 201/6 |
| 4,094,746 | A * | 6/1978 | Masciantonio et al. | 208/403 |
| 4,178,215 | A * | 12/1979 | Kiritani et al. | 201/6 |
| 4,201,655 | A * | 5/1980 | Theodore et al. | 201/24 |

(Continued)

FOREIGN PATENT DOCUMENTS

DE 196 80 166 C1 9/2001

(Continued)

OTHER PUBLICATIONS

Machine translation of JP 07109465 A.*

(Continued)

*Primary Examiner*—Walter D Griffin
*Assistant Examiner*—Natasha Young
(74) *Attorney, Agent, or Firm*—Kenyon & Kenyon LLP

(57) ABSTRACT

Methods for pretreating and improving coking coal quality for producing blast-furnace coke by: (a) rapid-heating the coal charge in a fluidized-bed to a temperature range between not lower than 300° C. and not higher than the temperature at which the coal charge begins to soften, at a rate of 30 to $10^3$ ° C./min., (b) classifying the rapid-heated coal charge to fine- and coarse-size coal, and then (c-1) briquetting the fine-size coal or (c-2) rapid-heating the fine- and coarse-size coal individually in a pneumatic preheater to a temperature range between not lower than 300° C. and not higher than the temperature at which the coal charge begins to soften, at a rate of $10^3$ to $10^5$ ° C./min., and (d) forming the fine-size coal.

7 Claims, 4 Drawing Sheets

U.S. PATENT DOCUMENTS

| | | | | |
|---|---|---|---|---|
| 4,425,303 | A * | 1/1984 | Schilling et al. | 422/142 |
| 6,033,528 | A * | 3/2000 | Sakawa et al. | 201/1 |
| 2005/0155281 | A1 * | 7/2005 | Clark | 44/550 |

FOREIGN PATENT DOCUMENTS

| | | | |
|---|---|---|---|
| DE | 19680166 | C1 | 9/2001 |
| JP | 07109465 | A * | 4/1995 |
| JP | 07109466 | A * | 4/1995 |
| JP | A-7-109465 | | 4/1995 |
| JP | A-7-118661 | | 5/1995 |
| JP | A-7-118662 | | 5/1995 |
| JP | A-7-126626 | | 5/1995 |
| JP | A-7-126653 | | 5/1995 |
| JP | A-7-126657 | | 5/1995 |
| JP | A-8-127779 | | 5/1996 |
| JP | A-8-209150 | | 8/1996 |
| JP | A-8-259956 | | 10/1996 |
| JP | 9-48977 | | 2/1997 |
| JP | A-9-118883 | | 5/1997 |
| JP | 11-2410734 | | 9/1999 |
| KR | 178327 | | 4/1999 |
| WO | WO 96/23852 | | 8/1996 |

OTHER PUBLICATIONS

Machine translation of JP 11241073 A, which was published Sep. 7, 1999.*

English translation of JP 09048977 A, which was published Feb. 1997.*

English translation of JP 11241073 A, which was published Sep. 1999.*

Japanese Notice of Reasons for Rejection dated Oct. 23, 2008 issued in corresponding Japanese Application No. 2003-319772.

* cited by examiner

METHOD FOR PRETREATING AND IMPROVING COKING COAL QUALITY FOR BLAST FURNACE COKE

BACKGROUND OF THE INVENTION

1. Field of the Invention

This invention relates to method for quality pretreating and improving coking coal (coal for making coke) quality, by heating, in the manufacture of coke for blast furnace use.

2. Description of Related Art

In order to maintain good permeability in the blast furnace, coke for blast furnace operation is required to have a predetermined strength. Therefore, high-quality coals (such as strongly-coking coals) have conventionally been used as the coal charge.

As high-quality coal resources are being depleted, it is necessary to use large quantities of low-quality coals (non- or slightly-coking) as a main source of coals for metallurgical coke-making and supply of blast furnace coke.

As coke strength depends greatly on the caking properties of coal and low-quality coals, and they are unsuited to use as metallurgical coals, many pretreatment methods to enhance the caking properties of low-quality coal have been proposed.

As rapid-heating is in particular effective for improving the properties (caking properties) of non- or slightly-coking coals, several coke manufacturing methods incorporating such rapid-heating have been proposed (such as Japanese Unexamined Patent Publication (Kokai) Nos. 07-109465, 07-118661, 07-118662, 07-126626, 07-126653, 07-126657, 08-127779, 08-209150, 08-259956 and 09-118883).

For example, Japanese Unexamined Patent Publication (Kokai) No. 08-209150 discloses a method for manufacturing blast furnace coke by carbonizing a blended coal comprising strongly-coking coal of 40 to 90 wt % and the balance comprising non- or slightly-coking coal in which the non- or slightly-coking coal is classified to fine coal not more than 0.3 mm in size and coarse coal over 0.3 mm in size after preheating to between 250 and 350° C., the fine coal is rapidly heated to a temperature range between the temperature at which the non- or slightly-coking coals begins to soften and the maximum fluidity temperature thereof at a rate of $1\times10^3$ to $1\times10^{5}$° C./min., the heated fine coal is then hot-briquetted under a pressure of 5 to 1000 kg/cm$^2$ while being held in said temperature range, and the hot-briquetted fine coal is charged into a coke oven together with the strongly-coking coal and coarse non- or slightly-coking coal preheated to between 250 and 350° C.

This method, proposed by the applicant and with attention focused on the thermal properties of non- or slightly-coking coals, essentially comprises the steps of size classification after preheating, rapid-heating of the classified fine-size coal, hot-briquetting after rapid-heating, and blending and carbonizing with strongly-coking coal and the classified coarse-size coal, affords greater than ever improvement in the strength of coke prepared from low-quality coal, expands the range of metallurgical coal choice and provides greater productivity enhancement.

The applicant also proposed in Japanese Unexamined Patent Publication (Kokai) No. 09-118883 a method for manufacturing blast furnace coke comprising the steps of preheating charged coal to between 250 and 350° C., classifying the preheated coal to coarse and fine coals by a cyclone, adjusting the caking power index of the classified fine coal to under 80% by adding non- or slightly-coking coals, rapid-heating mixed coal to between 350 and 480° C. at a rate of 100 to 1000° C./sec., agglomerating the heated coal, blending the agglomerated coal with the classified coarse coal, and carbonizing the blended coal in the coke oven.

The conventionally proposed or disclosed methods to reform metallurgical coals by rapid-heating are fundamentally based on classifying coals into non- or slightly-coking coals and strongly-coking coals, classifying the non- or slightly-coking coals into fine and coarse coals, and rapid-heating each of the coals thus classified individually. Although, accordingly, this effectively improves the properties (caking properties) of coals, the operational efficiency is not very high because the methods involve many steps before charging into the coke oven.

With a view to affording greater use of non- or slightly-coking coals and expanding the range of metallurgical coal choices, the applicant also proposed in Japanese Unexamined Patent Publication (Kokai) No. 08-259956 a method for manufacturing blast furnace coke comprising the steps of rapid-heating a mixture of non- or slightly-coking coals of 10 to 30 wt % and the balance caking coal at a rate of $1\times10^2$ to $1\times10^{6}$° C./min., to a temperature range −100° C. to +10° C. of the temperature at which the mixed coal begins to soften and carbonizing the rapid-heated coal in the coke oven.

Though affording improvement in operational efficiency, rapid-heating of a mixture of strongly-coking coals and non- or slightly-coking coals implemented in this method requires further improvement in the stability of coke strength through the improvement of caking properties.

While many excellent proposals have been made in relation to rapid-heating to improve the caking properties of coals, more technologies to permit volume production of metallurgical coke to further enhance the operational efficiency and productivity of blast furnaces while increasing the use of non- or slightly-coking coals and, at the same time, securing the conventional or greater coke strength must be developed.

SUMMARY OF THE INVENTION

As described above, technologies to permit volume production of metallurgical coke to further enhance the operational efficiency and productivity of blast furnaces while increasing the use of non- or slightly-coking coals and, at the same time, securing the conventional or greater coke strength must be developed.

The object of this invention is to provide a method for pretreating and improving coal quality that provides greater coke strength and greater operational efficiency to meet the above requirements.

Based on an assumption that treatment of non- or slightly-coking coals affects coke strength, the conventional coal qualities improving methods classify coals according to the degree of caking properties and rapidly heat each of the classified coals as required by their properties.

In contrast, the inventor arrived at the following findings by taking into account the need to use more non- or slightly-coking coals than caking coals in the manufacture of blast furnace coke having the required strength:

The obtained findings were: (i) improvement of coke strength depends on the improvement of caking properties of non- or slightly-coking coals used in large quantities; (ii) improvement of the caking properties of caking coals that is used in small quantities and does not necessarily require improvement of caking properties does not present a major contribution to the enhancement of coke strength; and, as a consequence, (iii) there is no need to classify non- or slightly-coking coals from caking coals before rapid-heating to enhance caking properties.

Unlike the conventional concepts, the above idea is based on the elimination of classification of non- or slightly-coking coals from strongly-coking coals.

Based on the above idea, the inventor investigated the strength of cokes by rapid-heating various metallurgical coals comprising various percentages of caking coals and non- or slightly-coking coals, classifying and forming fine-size coals after heating, blending the formed coals with coarse-size coals and carbonizing the blended coals.

This study led to the following findings: (iv) it is not essentially necessary to classify non- or slightly-coking coals from caking coals in preparation for the rapid-heating intended for the enhancement of caking properties, and (v) required coke strength can be obtained more stably by heating mixed metallurgical coals comprising caking coals and non- or slightly-coking coals.

The gist of the present invention based on the above findings is as follows:

(1) A method for pretreating and improving coking coal quality, by heating, for producing blast furnace coke comprising the steps of:

(a) rapid-heating said coking coal in a fluidized-bed to a temperature range between not lower than 300° C. and not higher than the temperature at which the coking coal begins to soften, at a rate of 30 to $10^{3}$° C./min., (b) classifying the rapid-heated coking coal to fine-size coal and coarse-size coal, and (c) forming said fine-size coal.

(2) A method for pretreating and improving coking coal quality, by heating, for producing blast furnace coke comprising the steps of:

(a) rapid-heating said coking coal in the fluidized-bed to a temperature range between not lower than 250° C. and not higher than 300° C., at a rate of 30 to $10^{3}$° C./min., (b) classifying the rapid-heated coking coal to fine-size coal and coarse-size coal, (c) rapid-heating said fine-size coal and coarse-size coal individually in a pneumatic preheater to a temperature range between not lower than 300° C. and not higher than the temperature at which the coking coal begins to soften, at a rate of $10^{3}$ to $10^{5}$° C./min., and (d) forming said fine-size coal.

(3) The method for pretreating and improving coking coal quality, by heating, for producing blast furnace coke according to (1) or (2), wherein said coking coal is a blended coal of caking coal and non- or slightly-coking coal.

(4) The method for pretreating and improving coking coal quality, by heating, for producing blast furnace coke according to (3), wherein said blended coal contains non- or slightly-coking coal at 10 to 70%.

(5) The method for pretreating and improving coking coal quality, by heating, for producing blast furnace coke according to any of (1) to (4), wherein exhaust gas from a fluidized-bed and/or a pneumatic preheater is heated and supplied from the bottom of said fluidized-bed.

(6) The method for pretreating and improving coking coal quality, by heating, for producing blast furnace coke according to any of (1) to (5), wherein said coking coal is rapidly heated in said fluidized-bed at a rate less than 30 to 90° C./min.

(7) The method for pretreating and improving coking coal quality, by heating, for producing blast furnace coke according to any of (1) to (6), wherein said fine-size coal is not larger than 0.5 mm in size and said coarse-size coal is over 0.5 mm in size.

(8) The method for pretreating and improving coking coal quality, by heating, for producing blast furnace coke according to any of (2) to (7), wherein exhaust gas from the coke oven is heated and supplied from the bottom of said pneumatic preheater.

(9) The method for pretreating and improving coking coal quality, by heating, for producing blast furnace coke according to any of (2) to (8), wherein said fine-size coal is rapidly heated in said pneumatic preheater at a rate of $10^{3}$ to $10^{5}$° C./min.

(10) The method for pretreating and improving coking coal quality, by heating, for producing blast furnace coke according to any of (2) to (9), wherein said coarse-size coal is rapidly heated in said pneumatic preheater at a rate of $10^{3}$ to $10^{5}$° C./min.

(11) The method for pretreating and improving coking coal quality, by heating, for producing blast furnace coke according to any of (1) to (10), wherein said fine-size coal is formed into agglomerates not larger than 0.5 mm in size.

This invention permits volume production of high-strength coke for blast furnace use by using large quantities of non- or slightly-coking coals as it can significantly enhance the caking properties of coking coals without classifying non- or slightly-coking coals from caking coals.

Accordingly, this invention is highly conducive to cutting the cost of iron and steel production by increasing the operational efficiency and productivity of blast furnaces.

DESCRIPTION OF THE PREFERRED EMBODIMENTS

Figure 1:
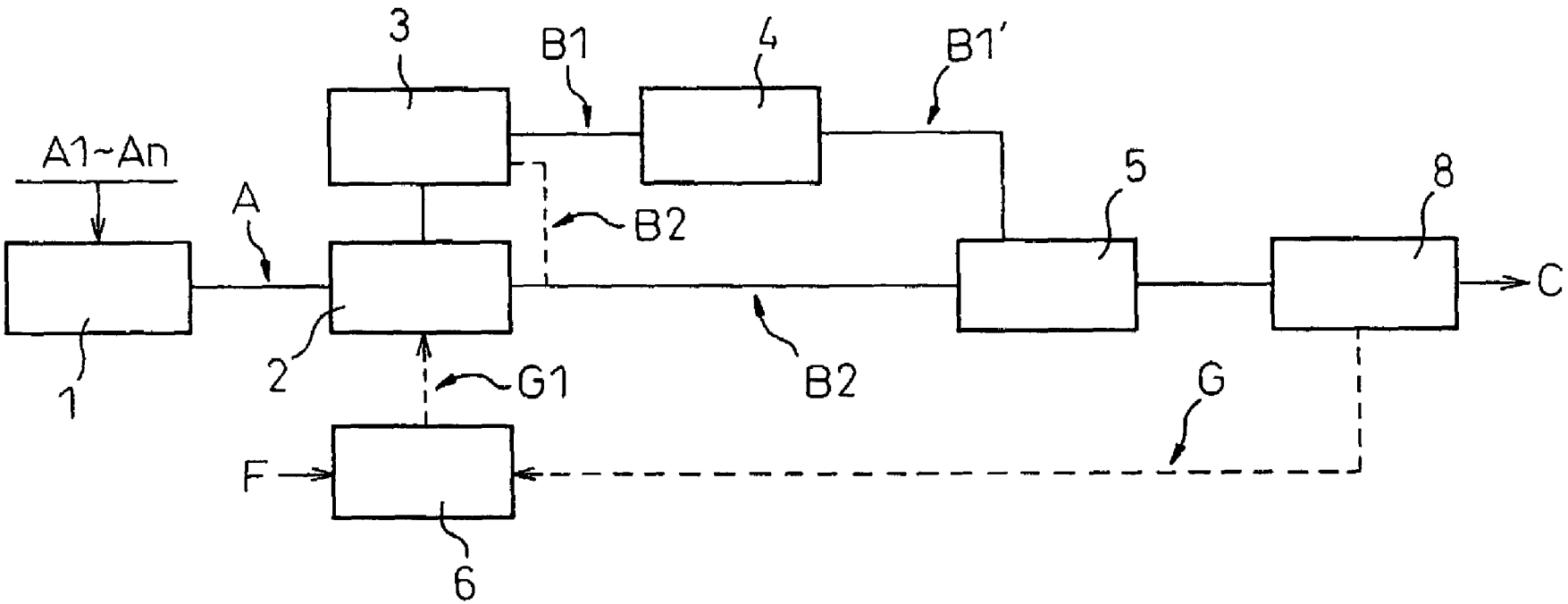
FIG. 1 shows a preferred embodiment of this invention.

This invention is described by reference to the accompanying drawings. FIG. 1 shows a preferred embodiment of this invention. In this invention, multiple grades A1 to An of coals are, as they are (without being classified by grade, property [caking property] and size) stored in a blending-storage bin 1 for use as a coal charge A.

This is the first feature (starting idea) of this invention that is different from the conventional coal charge preparation methods.

The coal charge A containing caking and non- or slightly-coking coals is supplied to a fluidized-bed 2 where it is fluidized and rapidly heated, by a high-temperature gas G1, to a temperature range (temperature range reached by heating) between not lower than 300° C. and not higher than the temperature at which the coal charge A begins to soften, at a rate of 30 to $10^{3}$° C./min.

Figure 4:
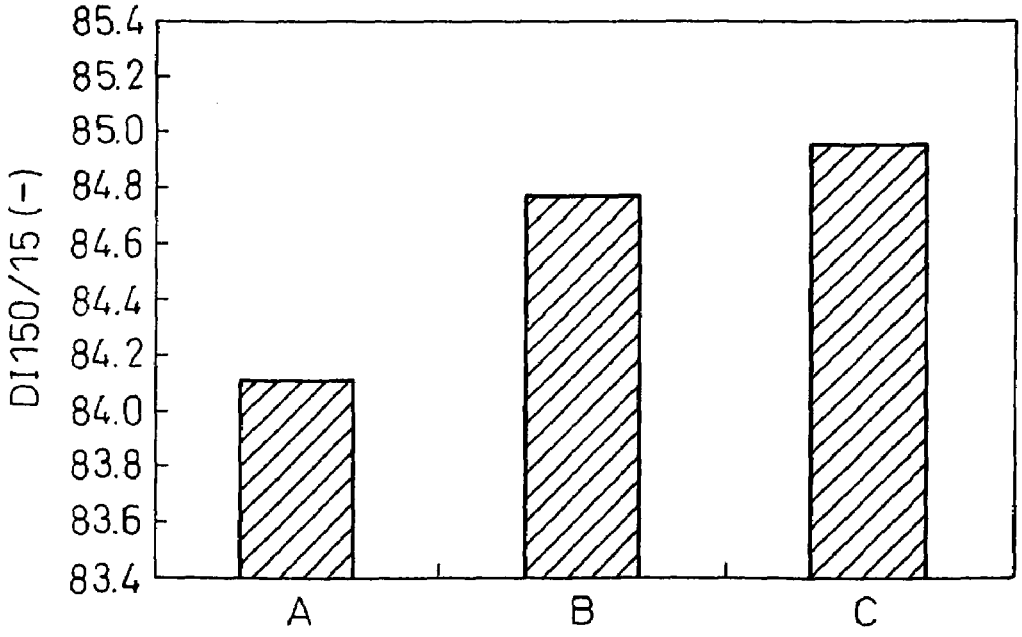
FIG. 4 shows the relationship between coke strength and patterns (A, B and C) of rapid-heating.

The inventor empirically confirmed and disclosed (as in Japanese Unexamined Patent Publication (Kokai) No. 08-209150) that rapid-heating of non- or slightly-coking coals of certain grades to a temperature range (temperature range reached by heating) between not lower than 300° C. and not higher than the temperature (400 to 450° C.) at which said coals begins to soften (at a rate of $10^{2}$ to $10^{5}$° C./min.) increases caking properties and, as a result, coke strength. The inventor empirically confirmed that rapid-heating of blended coals of non- or slightly-coking coals with caking coals to said temperature range reached by heating also increases their caking properties and, as a result, coke strength $D^{150/15}$. FIG. 4 shows the empirical results obtained.

Coke strength $D^{150/15}$ is an index that shows the proportion of a coke sample remaining on the 15 mm screen after impacts of 150 rotations have been applied in a drum tester according to JIS (Japanese Industrial Standard) K2151.

Three coke strengths (A, B and C) shown in FIG. 4 were obtained by applying three patterns of rapid-heating (A, B and C) to blended coals containing non- or slightly-coking coals of 10 to 70 mass % (whose softening begins at 400° C.) under the conditions shown in Table 1.

As can be seen in FIG. 4, the coke strengths obtained by rapid-heating patterns B and C (the softening starting temperature of non- or slightly-coking coals [the upper limit of the temperature range reached by heating]:400° C.>ultimate temperature:340° C.>300° C. [the lower limit of the temperature range reached by heating]) are much higher than the coke strength obtained by rapid-heating pattern A (ultimate temperature 275° C.<300° C. [the lower limit of the temperature applied by this invention]) that was applied for the purpose of comparison.

because excess presence of non- or slightly-coking coals, though it enhances caking properties, inhibits the manufacture of coke having necessary strength for blast furnace use.

While there is no particular need to set the lower limit for the blending ratio, it is preferable, in view of the object of this invention, to blend non- or slightly-coking coals at not less than 10 mass %.

The fluidizing and heating conditions in the fluidized-bed are described below.

As the effect of rapid-heating to improve the caking properties of coal charges appears when they are heated to 300° C. or above, the lower limit of the heating temperature range is set at 300° C.

If heated to above the temperature at which softening begins, coals generally decompose, generate gases and lose caking properties. Therefore, the upper limit of the heating temperature range is set at the point at which softening of the coal charge begins.

Because the coal charge A is a blend of different coals, it is impossible to determine the softening starting temperature thereof. Because, however, rapid-heating aims at enhancing the caking properties of non- or slightly-coking coals, it is appropriate to adopt the softening starting temperature (approximately 400 to 450° C.) of the non- or slightly-coking coals contained in the coal charge A as the softening starting temperature of the coal charge A. Or, otherwise, the softening starting temperature of the coal charge A may be set by considering the blending proportions of the individual coals based on said softening starting temperature (approximately 400 to 450° C.).

It is also possible to adopt the lowest among the softening starting temperatures of the individual non- or slightly-coking coals as the softening starting temperature of the coal charge A.

It is preferable that the high-temperature gas G1 used for fluidizing and rapid-heating the coal charge A in the fluidized-bed 2 is a neutral or non-oxidizing gas at 200 to 500° C.

FIG. 1 shows how the high-temperature gas G1 is produced by heating the exhaust gas G from the coke oven (carbonizing furnace) with the combustion heat of fuel F in the high-temperature gas producing furance 6. The high-temperature gas may also be obtained from a separated supply source or generated separately.

TABLE 1

| | Fluidizing conditions | | | | Heating conditions | |
|---|---|---|---|---|---|---|
| Rapid-heating | Layer thickness (mm) | Gas temperature (° C.) | Flow rate ($Nm^3/h$) | Residence time (s) | Temperature rise rate (° C./min.) | Ultimate temperature (° C.) |
| A | 100 | 293 | 27400 | 151 | 109 | 275 |
| B | 100 | 369 | 24000 | 151 | 141 | 340 |
| C | 300 | 381 | 26500 | 454 | 47 | 340 |

The coal charges used in this invention are blends of non- or slightly-coking coals with strongly-coking coals. Although there is no particular need to limit the blending ratio, the upper limit of non- or slightly-coking coals is set at 70 mass %

The heating rate must be not slower than 30° C./min. because, if it is under 30° C./min., the coal charge cannot be rapidly heated to 300° C. or above but remains only in a preheated state, as a result of which the caking property improving effect is unobtainable. To insure the attainment of said effect, it is preferable to set the heating rate at 40° C./min. or above.

If the heating rate exceeds $10^{3}$° C./min., the residence time of the coal charge in the fluidized-bed must be shortened so much that time-setting becomes difficult. Therefore, there is a possibility that the coal charge is heated to beyond the temperature at which softening begins.

The coal charge must not be heated to beyond the softening starting temperature because the resulting coal decomposition and gas generation cause caking property deterioration. Therefore, the heating rate must not be faster than $10^{3}$° C./min.

To insure rapid-heating of the coal charge to a temperature not higher than the softening starting temperature, it is preferable, when considering the residence time, to set the heating rate to not faster than 150° C./min. Less than 90° C./min. is still more preferable.

The coarse-size coal B2 in the coal charge A fluidized and rapidly heated under said conditions is discharged from the fluidized-bed 2 and stored in a blending-storage bin 5.

The fine-size coal B1 in the coal charge A is carried by the stream of high-temperature gas to a classifier 3 (such as a cyclone) where it is recovered as such.

Depending on grades and moisture contents, different coals have different crushabilities and particle size distributions. Therefore, it is unnecessary to specify any particular critical particle size at which the fine-size coals and coarse-size coals are distinguished.

The critical particle size may be set as required depending on the properties of the individual coals making up the coal charge, the properties of caking and non- or slightly-coking coals, and the desired coke strength.

Usually, the critical particle size is 0.5 mm. Coals 0.5 mm or smaller are treated as fine-size coals and those over 0.5 mm as coarse-size coals. It is preferable that the same classification standard is used for this invention.

In an agglomerator 4, the recovered fine-size coal B1 is formed to the spherical or pillow-shaped coal agglomerate B1', preferably over 0.5 mm in size. The coal agglomerate B' is conveyed to the blending-storage bin 5 where they are stored together with the coarse-size coal B2.

Though not particularly specified, the upper particle size limit of the coal agglomerate should, preferably, not exceed the maximum particle size (approximately 6 mm) of the coarse-size coal in order to ensure uniform blending with the coarse-size coal.

The agglomerator 4 may be of any type. For example, the roll press type or roll compactor type is preferable as the agglomerator or pelletizer to form the coarse-size coal into the spherical or pillow-shaped agglomerate.

In the agglomerator 4, appropriate quantities of caking coal and/or strongly-coking coal of fine size (preferably 0.5 mm or under) and other coke materials may be blended with the fine-size coal B1.

A portion of the coarse-size coal B2 conveyed by the high-temperature gas is recovered by the classifier 3 and stored in the blending bin 5.

The blend of the coarse-size coal B2 and coal agglomerate B1' stored in the blending bin 5 are charged into a coke oven 8 and then discharged therefrom as coke C after being carbonized.

Figure 3:
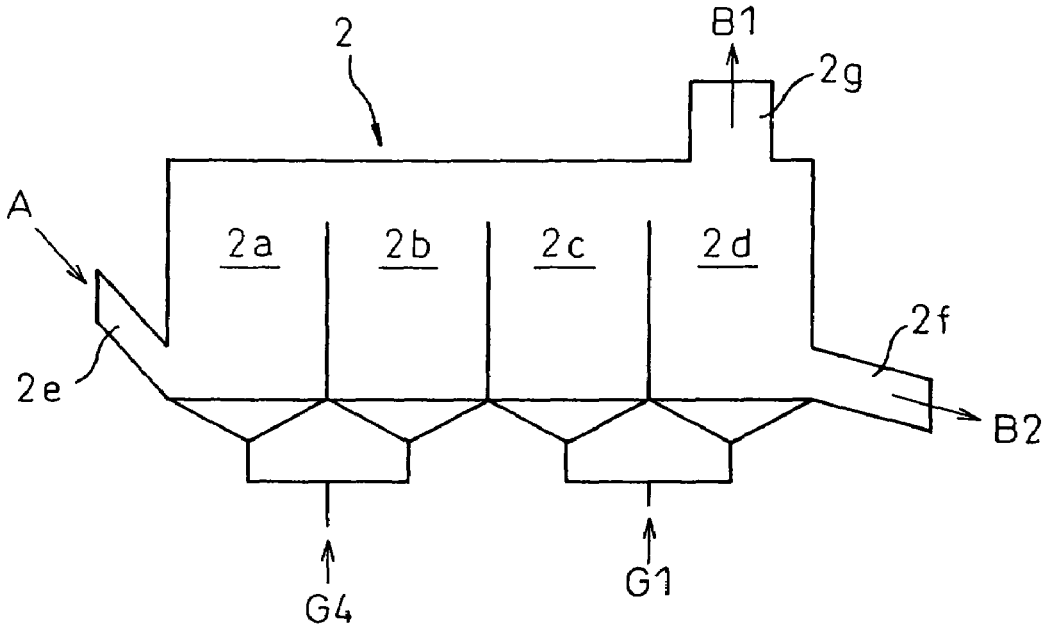
FIG. 3 schematically shows the structure of a fluidized-bed.

FIG. 3 shows an example of a horizontally long fluidized-bed comprising fluid-bed chambers 2*a* to 2*d*. While the fluid-bed chambers 2*a* and 2*b* serve as drying and preheating chambers (into which a drying and preheating gas G4 is blown), the fluid-bed chambers 2*c* and 2*d* serve as rapid-heating chambers (into which a high-temperature gas G1 is blown). The coal charge A charged through the charging port 2*e* is dried, fluidized and rapidly heated. While the coarse-size coal B2 is discharged through the discharging port 2*f*, the fine-size coal B1 is discharged through the gas discharging port 2*g* together with the high-temperature gas.

The horizontally long fluidized-bed described above, which performs fluidizing and rapid-heating after drying and preheating, is preferable for the achievement of the caking properties enhancing effect. However, the fluidized-bed used in the methods of this invention is by no means limited to the horizontally long one shown in FIG. 3.

The fluidized-bed used in the methods of this invention is not limited to any particular type so long as the coal stock is fluidized and rapidly heated. For example, a vertically long fluidized-bed can also be used.

Figure 2:
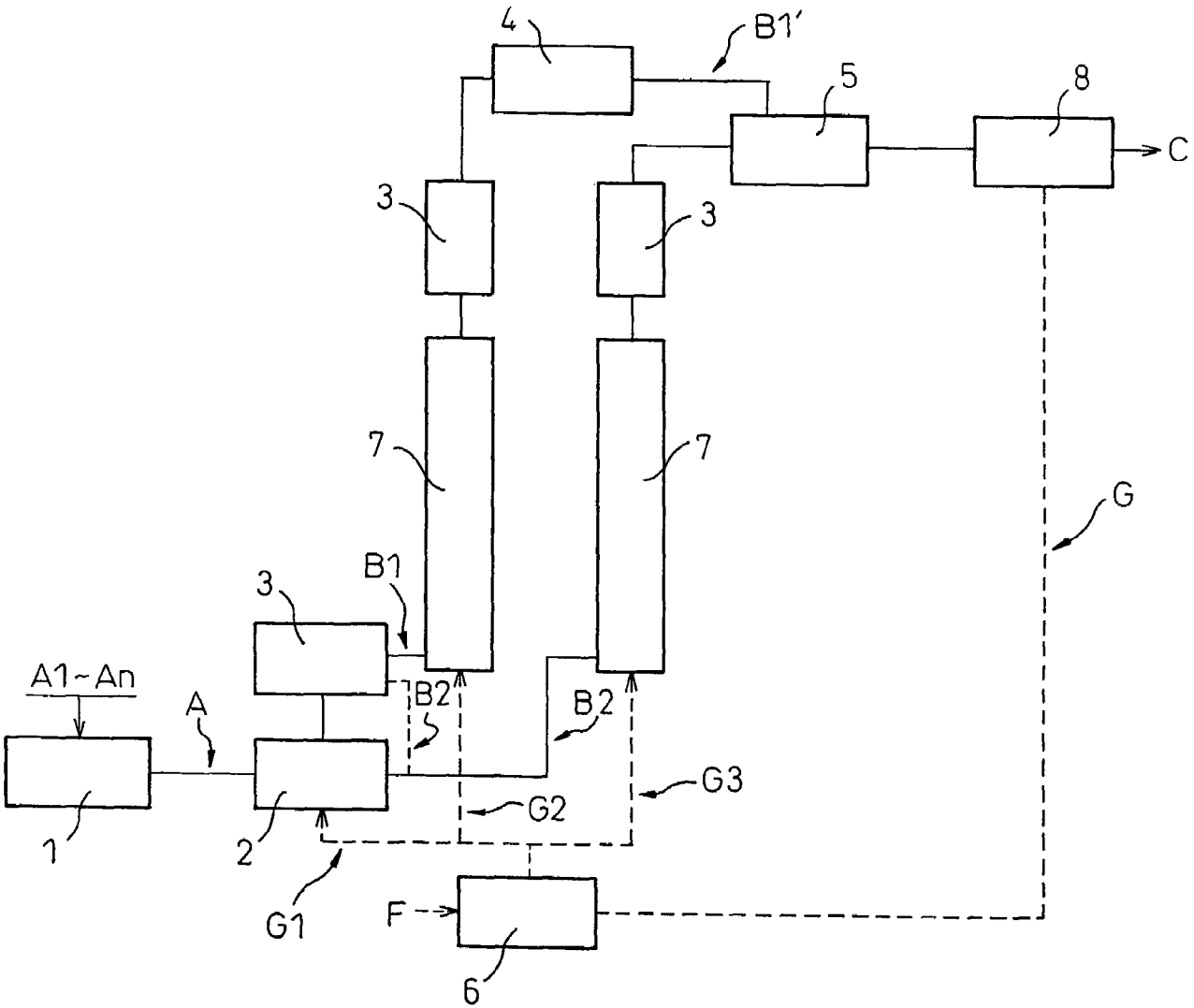
FIG. 2 shows another preferred embodiment of this invention.

FIG. 2 shows another preferred embodiment of this invention. Though differing in that a pneumatic preheater 7 is connected to each of the fluidized-bed 2 and classifier 3, the preferred embodiment shown in FIG. 2 is analogous to the one shown in FIG. 1 as it aims at the same object.

The fluidized-bed 2, like the one in the preferred embodiment shown in FIG. 1, rapidly heats the coal charge A, by the high-temperature gas G1, to the temperature range not lower than 250° C. and not higher than 350° C. at a rate of 30 to $10^{3}$° C./min.

While the lower limit of the heating temperature in the fluidized-bed 2 is set at not lower than 250° C. in order to achieve the caking property enhancing effect of rapid-heating as much as possible, the upper limit is set at not higher than 350° C. to inhibit the progress of the thermal cracking of coal, and lowering of caking properties during the travel from the fluidized-bed 2 to the pneumatic preheater 7.

The fine-size coal B1 recovered in the classifier 3 is rapidly heated again, by the high-temperature gas G2 blown in through the bottom, to the temperature range between not lower than 300° C. and not higher than the temperature at which softening of the coal charge begins, at a rate of $10^{3}$ to $10^{5}$° C./min.

The fine-size coal B1 discharged through the top of the pneumatic preheater 7 together with the high-temperature gas G2 is recovered by a classifier 3 (such as a cyclone) and formed by an agglomerator 4 to the spherical or pillow-shaped coal agglomerate B1', preferably over 0.3 mm in size.

The coal agglomerate B1' is conveyed to a blending bin 5 and stored together with the coarse-size coal B2.

The coarse-size coal B2 discharged from the fluidized-bed 2 is charged into the pneumatic preheater 7 through the lower side thereof and rapidly heated again, by the high-temperature gas G3 blown in through the bottom, to a temperature range between not lower than 300° C. and not higher than the temperature at which softening of the coal charge begins, at a rate of $10^3$ to $10^{5}$° C./min.

The coarse-size coal B2 discharged through the top of the pneumatic preheater 7 together with the high-temperature gas G3 is recovered by a classifier 3 (such as a cyclone), conveyed to a blending bin 5 and stored with the coal agglomerate B1'.

The coarse-size coal B2 and coal agglomerate B1' stored in the blending bin 5 are charged into a coke oven 8 as a material for producing coke, carbonized and discharged therefrom as coke C.

The fine- and coarse-size coals rapidly heated in the fluidized-bed are rapidly heated again, by the high-temperature gas G3 blown in through the bottom, to the temperature range between not lower than 300° C. and not higher than the temperature at which softening of the coal charge begins, at a rate of $10^3$ to $10^{5}$° C./min., because the caking properties of the coal charge comprising the caking coals and non- or slightly-coking coals are maximized by the combination of the effects to enhance caking properties by the rapid-heating in the fluidized-bed and the subsequent rapid-heating in the pneumatic preheater.

The present invention is based on the synergistic effect just described which the inventor discovered through experiment.

The lower limit of the heating rate in the pneumatic preheater is set at $10^{3}$° C./min. because the caking properties of the fine- and coarse-size coals are not enhanced uniformly below that rate, as a result of which it becomes difficult to stably maintain the desired coke strength.

Though a heating rate of not less than $10^{3}$° C./min. will thus suffice, the upper limit thereof is set at $10^{5}$° C./min. that is approximately the heating rate obtainable from aerial rapid-heating.

The rapid-heating rates between $10^3$ and $10^{5}$° C./min. produce the desired caking properties enhancing effect on both fine- and coarse-size coals. Because of difference in volume and mass, however, the heating rate between $10^3$ and $10^{5}$° C./min. is preferable for the fine-size coal and that between $10^3$ and $10^{4}$° C./min. for the coarse-size coal.

The fine- and coarse-size coals are classified as described earlier. The high-temperature gases G2 and G3 blown in through the bottom of the pneumatic preheater are, like the high-temperature gas G1, preferably a neutral or non-oxidizing gas at 200 to 500° C.

Concretely, the gases G2 and G3 may be produced in a high-temperature gas generating furnace 6 by heating the exhaust gas G from the coke oven 8 with the combustion heat of the fuel F. Of course, the high-temperature gases G2 and G3 may be obtained from another supply source or produced afresh.

EXAMPLES

Examples of this invention will be described. The examples were implemented under conditions to confirm the practicability and effect of the present invention. Therefore, the present invention is by no means limited to the conditions employed for the implementation of the examples. The present invention can be embodied under various other conditions without departing from its spirit and scope.

Example 1

A coal charge comprising non- or slightly-coking coal of 50 mass % and caking coal of 50 mass % was rapidly heated in a fluidized-bed under the conditions given in Table 2 and converted to coke in the process shown in FIG. 1, and the coke strength $DI^{150/15}$ was measured. The temperature at which the non- or slightly-coking coal started to soften was 400° C.

Figure 5:
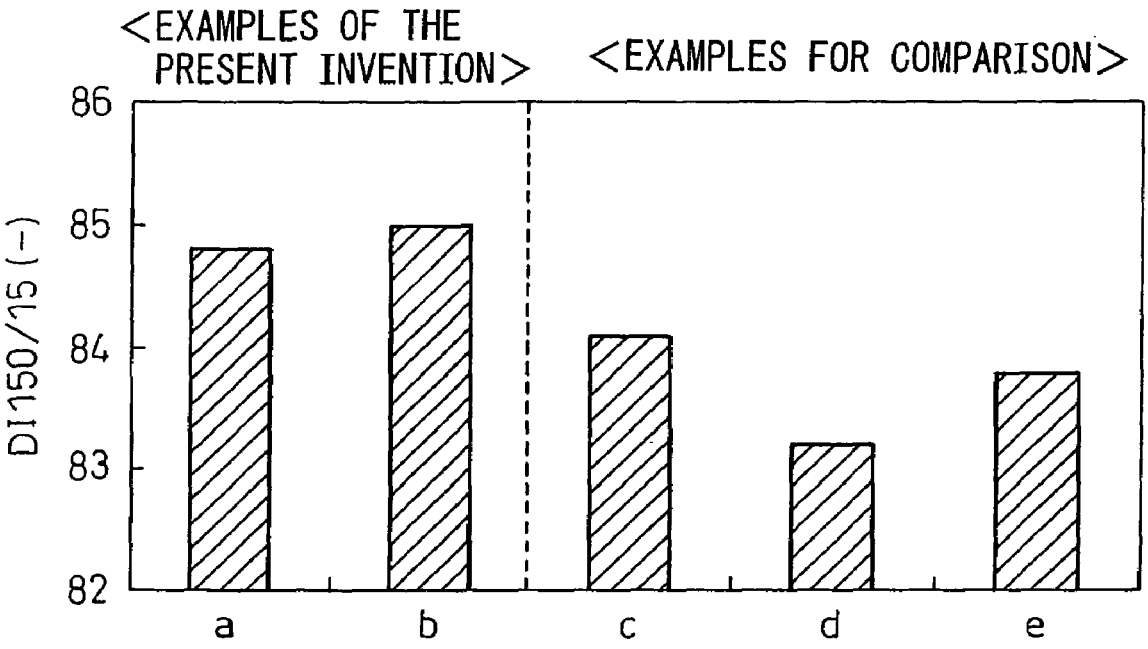
FIG. 5 shows the relationship between coke strength and patterns (a, b, c, d and e) of rapid-heating.

The results are shown in Table 3 and FIG. 5. It was found that rapid-heating of coal according to this invention (under the conditions a and b) increases coke strength and leads to the manufacture of high-strength coke.

Table 3 also shows the strengths of cokes prepared by applying rapid-heating under the conditions (c, d and e) outside the scope of this invention for the purpose of comparison.

TABLE 2

| | | Operating conditions of fluidized-bed | | | | Coal heating conditions in fluidized-bed | |
|---|---|---|---|---|---|---|---|
| | Rapid-heating conditions | Coal layer thickness (mm) | Heating gas temperature (° C.) | Heating gas flow rate ($Nm^3/h$) | Residence time (s) | Temperature rise rate (° C./min.) | Ultimate temperature (° C.) |
| Examples of the present invention | a | 100 | 369 | 24000 | 151 | 132 | 340 |
| | b | 300 | 381 | 26500 | 454 | 44 | 340 |
| Examples for comparison | c | 100 | 293 | 27400 | 151 | 106 | 275 |
| | d | 450 | 293 | 27400 | 681 | 22 | 255 |
| | e | 500 | 381 | 28000 | 756 | 26 | 331 |

TABLE 3

| | Rapid-heating conditions | Coke strength $DI^{150/15}$; DI150/15(−) |
|---|---|---|
| Examples of the present invention | a | 84.8 |
| | b | 85.0 |
| Examples for comparison | c | 84.1 |
| | d | 83.2 |
| | e | 83.8 |

Obviously, the coke strengths obtained by this invention are adequate for blast-furnace use.

Example 2

A coal charge comprising non- or slightly-coking coal of 50 mass % and caking coal of 50 mass % was heated in a fluidized-bed under the conditions given in Table 4 and classified into coarse- and fine-size coals. The coarse- and fine-size coals were individually rapidly heated under the conditions given in Table 5 by using pneumatic preheater. Then, the coals were converted to coke in the process shown in FIG. 2, and the coke strength $DI^{150/15}$ was measured. The temperature at which the non- or slightly-coking coal started to soften was 400° C.

Figure 6:
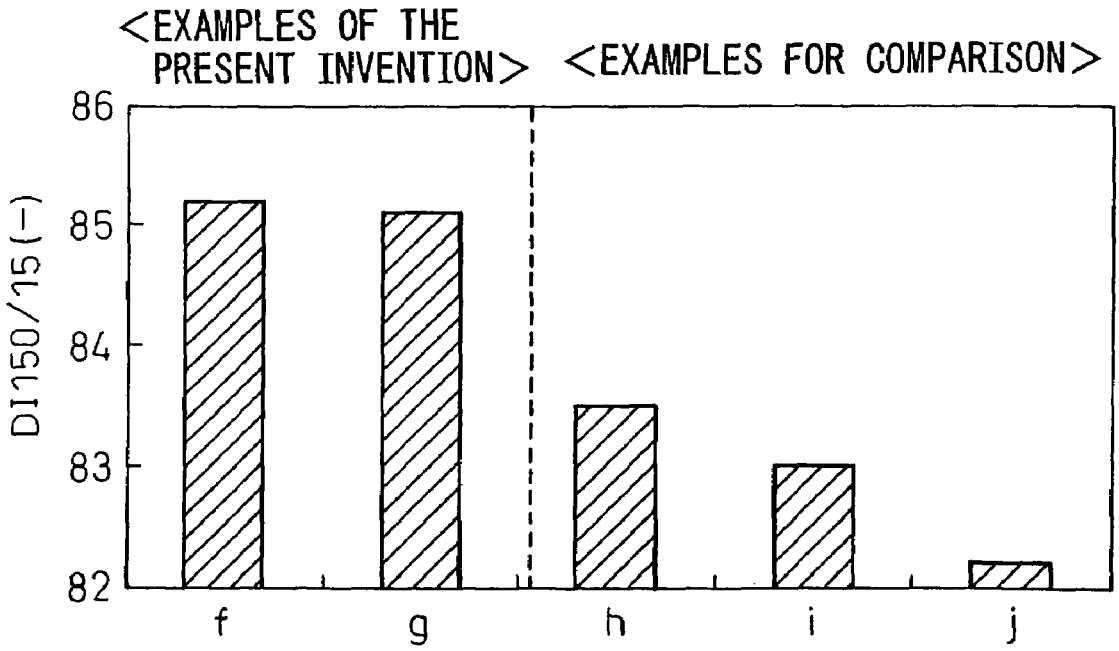
FIG. 6 shows the relationship between coke strength and patterns (f, g, h, i and j) of rapid-heating.

The results are shown in Table 6 and FIG. 6. It was found that rapid-heating of coal according to this invention (under the conditions f and g) increases coke strength and leads to the manufacture of high-strength coke.

Table 6 also shows the strengths of cokes prepared by applying rapid-heating under the conditions (h, i and j) outside the scope of this invention for the purpose of comparison.

TABLE 4

| | | Operating conditions of fluidized-bed | | | | Coal heating conditions in fluidized-bed | |
|---|---|---|---|---|---|---|---|
| | Rapid-heating conditions | Coal layer thickness (mm) | Heating gas temperature (° C.) | Heating gas flow rate ($Nm^3/h$) | Residence time (s) | Temperature rise rate (° C./min.) | Ultimate temperature (° C.) |
| Examples of the present invention | f | 100 | 293 | 27400 | 151 | 106 | 275 |
| | g | 100 | 337 | 26500 | 149 | 122 | 310 |
| Examples for comparison | h | 100 | 293 | 27400 | 151 | 106 | 275 |
| | i | 450 | 293 | 27400 | 681 | 22 | 255 |
| | j | — | — | — | — | — | — |

TABLE 5

| | Rapid-heating conditions | Heating gas temperature (° C.) | Heating gas flow rate ($Nm^3/h$) | Residence time (s) | Temperature rise rate (° C./min.) | Ultimate temperature (° C.) |
|---|---|---|---|---|---|---|
| | Rapid-heating conditions of coarse-size coal in pneumatic preheater | | | | | |
| Examples of the present invention | f | 440 | 15000 | 2.18 | 2669 | 363 |
| | g | 400 | 16000 | 2.07 | 1453 | 359 |
| Examples for comparison | h | 290 | 18000 | 2.05 | 336 | 286 |
| | i | 270 | 18500 | 2.07 | 163 | 260 |
| | j | — | — | — | — | — |
| | Rapid-heating conditions of fine-size coal in pneumatic preheater | | | | | |
| | f | 400 | 11000 | 0.74 | 9010 | 366 |
| | g | 400 | 11000 | 0.73 | 6619 | 371 |
| | h | 400 | 11000 | 0.74 | 9010 | 366 |
| | i | 400 | 11000 | 0.74 | 8675 | 361 |
| | j | — | — | — | — | — |

TABLE 6

| | Rapid-heating conditions | Coke strength $DI^{150/15}$; DI150/15(−) |
|---|---|---|
| Examples of the present invention | f | 85.2 |
| | g | 85.1 |
| Examples for comparison | h | 83.5 |
| | i | 83.0 |
| | j | 82.2 |

Obviously, the coke strengths obtained by this invention are adequate for blast-furnace use.

It can be presumed that approximately 50% of the increased coke strength, increased by this invention, is due to the rapid-heating in the fluidized-bed.

The invention claimed is:

1. A method for pretreating and improving metallurgical coal quality, wherein the metallurgical coal is a blended coal of non- or slightly-coking coals and strongly-coking coals, by heating, for producing blast furance coke comprising the steps of:

(a) rapid-heating said metallurgical coal in a fluidized-bed to a temperature range between not lower than 250° C. and not higher than 300° C., at a rate of 30 to 150° C./min., (b) classifying the rapid-heated metallurgical coal to fine-size coal and coarse-size coal, (c) rapid-heating said fine-size and coarse-size coal individually in a pneumatic preheater to a temperature range between not lower than 300° C. and not higher than the temperature at which the metallurgical coal begins to soften, at a rate of $10^3$ to $10^{5}$° C/min., and (d) forming said fine-size coal.

2. The method for pretreating and improving metallurgical coal quality, by heating, for producing blast furnace coke according to claim 1, wherein said blended coal contains non- or slightly-coking coal at 10 to 70%.

3. The method for pretreating and improving metallurgical coal quality, by heating, for producing blast furnace coke according to claim 1, wherein exhaust gas from a fluidized-bed and/or a pneumatic preheater is heated and supplied from the bottom of said fluidized-bed.

4. The method for pretreating and improving metallurgical coal quality, by heating, for producing blast furnace coke according to claim 1, wherein said metallurgical coal is rapidly heated in said fluidized-bed at a rate less than 30 to 90° C./min.

5. The method for pretreating and improving metallurgical coal quality, by heating, for producing blast furnace coke according to claim 1, wherein said fine-size coal is not larger than 0.5 mm in size and said coarse-size coal is over 0.5 mm in size.

6. The method for pretreating and improving metallurgical coal quality, by heating, for producing blast furnace coke according to claim 1, wherein exhaust gas from the coke oven is heated and supplied from the bottom of said pneumatic preheater.

7. The method for pretreating and improving metallurgical coal quality, by heating, for producing blast furnace coke according to claim 1, wherein said fine-size coal is formed into agglomerates not smaller than 0.5 mm in size.

* * * * *

UNITED STATES PATENT AND TRADEMARK OFFICE

CERTIFICATE OF CORRECTION

PATENT NO. : 7,645,362 B2
APPLICATION NO. : 10/938266
DATED : January 12, 2010
INVENTOR(S) : Kato et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1316 days.

Signed and Sealed this

Sixteenth Day of November, 2010

David J. Kappos

David J. Kappos
*Director of the United States Patent and Trademark Office*